US007073361B2

(12) United States Patent
Focken et al.

(10) Patent No.: US 7,073,361 B2
(45) Date of Patent: Jul. 11, 2006

(54) TANGENTIAL THREAD-ROLLING HEAD

(75) Inventors: Andreas Focken, Schwarzenbek (DE); Dirk Marbs, Wangelau (DE)

(73) Assignee: Fette GmbH, Schwarzenbek (DE)

( * ) Notice: Subject to any disclaimer, the term of this patent is extended or adjusted under 35 U.S.C. 154(b) by 0 days.

(21) Appl. No.: 11/008,986

(22) Filed: Dec. 13, 2004

(65) Prior Publication Data

US 2005/0172689 A1 Aug. 11, 2005

(30) Foreign Application Priority Data

Feb. 7, 2004 (DE) ..... 10 2004 006 125

(51) Int. Cl.
*B21H 3/04* (2006.01)

(52) U.S. Cl. ..... 72/104

(58) Field of Classification Search ..... 72/102, 72/103, 104, 108, 121; 470/66, 70
See application file for complete search history.

(56) References Cited

U.S. PATENT DOCUMENTS 4,336,703 A * 6/1982 Thomas ..... 72/104
4,617,816 A * 10/1986 Brinkman ..... 72/104
6,202,461 B1 * 3/2001 Brinkman ..... 72/104
6,598,444 B1 * 7/2003 Focken ..... 72/104

FOREIGN PATENT DOCUMENTS

| | | |
|---|---|---|
| DE | 871703 | 3/1953 |
| EP | 0 811 443 B1 | 12/2001 |
| FR | 510133 | 2/1920 |

* cited by examiner

*Primary Examiner*—Ed Tolan
(74) *Attorney, Agent, or Firm*—Clark & Brody

(57) ABSTRACT

A tangential thread-rolling head comprising two fork-shaped rolling head arms in which thread-rolling dies are rotatably supported by means of parallel axles wherein the thread-rolling dies are in a lateral engagement with a pinion seated on the axles of a gearing coupling both thread-rolling dies and the thread-rolling dies and pinions have lateral jaws such that the jaws of the thread-rolling dies can be pushed into the jaws of the pinions laterally before the axles are mounted wherein the axles have disposed thereon an axially slidable bushing which is adapted to firmly be positioned axially against the pinion with the aid of locating means, wherein each bushing circumferentially has a fine pitch threaded portion which interengages with a female-threaded portion in a seating bore for the pinion and bushing and locking means are provided in the rolling head arms to lock the bushing in an occupied rotational position.

6 Claims, 2 Drawing Sheets

TANGENTIAL THREAD-ROLLING HEAD

FIELD OF THE INVENTION

The invention relates to a tangential thread-rolling head according to the preamble of claim 1.

BACKGROUND OF THE INVENTION

EP 0 811 443 B1 has made known a tangential thread-rolling head in which two thread-rolling dies are rotatably supported by two fork-shaped rolling head arms. The thread-rolling dies have to be in a certain position to each other at the beginning of a thread-rolling procedure and during the rolling procedure. For this purpose, a synchronized gearbox is disposed between the tangential rolling dies. The axle of each rolling die has arranged thereon a pinion which, on its front face, has a pair of diametrically opposed jaws which get into engagement with complementary jaws of the thread-rolling die. This transfers a rotational motion to the thread-rolling die from the pinion. The pinion, in turn, interengages with a gear where the two gears interengage with a central gear in order to ensure the uniformity of the rotational motion for the two thread-rolling dies.

It is understood that the thread-rolling dies are in a predetermined axial position towards each other. Typically, the thread-rolling dies cause a front face to bear against a stop which is defined by a forked portion of the fork-shaped arms. A particular metallic disk, e.g. made of copper, defines a stop surface which additionally causes a relatively low friction. To make the thread-rolling die bear against the stop, it is known to locate it axially by means of a bushing which is mounted on the axle for the thread-rolling die and the pinion. The bushing, in turn, is axially located by a further bushing which supports the gear meshing with the pinion. This bushing is pressed against a fixed contact surface of the rolling head arm by means of a screw.

As becomes apparent from this description such a procedure only helps to provide for a single adjustment of the axial position of the thread-rolling die. If it is to be changed the length of the second bushing would have to be reduced by grinding. The description further makes it evident that the tolerances will possibly be added up because of an interaction between a plurality of individual parts, which detracts from the accuracy of the axial position or axial rolling die clearance. Thus, for example, the contacting disk can wear down, which results in a change to the axial position of the thread-rolling die. The known means are unable to provide a compensation. However, the accuracy of the axial position or axial clearance of the rolling dies is of great significance for the accuracy of the thread to be produced by the thread-rolling dies.

BRIEF SUMMARY OF THE INVENTION

It is the object of the invention to provide a tangential thread-rolling head in which the axial rolling die clearance can be adjusted by simple means.

The object is achieved by the features of claim 1.

In the invention, the bushings which bear on a pinion each for the thread-rolling die circumferentially have a fine-pitch threaded portion which interengages with a female-threaded portion in a bore which seats the pinion and bushing. Further, locking means are provided which lock the bushing in an occupied rotational position. The bushings are rotatably supported and are also repositioned axially while being rotated. Therefore, the pinion and the thread-rolling die can be repositioned axially by means of the bushings. If a sufficient axial abutting action is achieved for the thread-rolling die the bushing is locked in place in the occupied rotational position.

Various possible options are conceivable to lock the bushing in its rotational position. In an aspect of the invention, a provision is made for the bushing to have indentations beside the fine pitch threaded portion, e.g. in the form of grooves, which are arranged at equal spacings at the circumference of the bushing. A clamping screw which interacts with one of the indentations is inserted into a threaded hole of the rolling head arm. According to another aspect of the invention, the clamping screw is adapted to be screwed into the threaded hole from the front end of the rolling head arm. This provides for particularly good accessibility.

The locked position of or the clamping screw for the bushing is released for an adjustment of the axial clearance. The bushing is rotated to an extent that the thread-rolling die becomes fixedly seated, which is done with a suitable key which interacts with appropriate key surfaces of the bushing, e.g. indentations in the front side of the bushing that faces it. It admittedly is conceivable to lock the bushing invariably in any rotational position. However, this is unnecessary in practice. It is sufficient for the bushing to be lockable at spaced-apart rotational positions which are offset by a small angle. This can be ensured, for example, by means of a certain number of indentations or grooves. For example, if the thread has a lead of 0.5 mm and ten grooves are provided the axial displacement is 0.05 mm from groove to groove. In the adjustment procedure described, after the thread-rolling die has been seated the bushing is rotated back up to the next indentation for engagement by the clamping screw, for example. The screw is then tightened to lock the bushing in its rotated position.

If the axial clearance of the thread-rolling die should increase for reasons of wear or the like a re-adjustment of the axial clearance can be performed in the manner described.

BRIEF DESCRIPTION OF THE DRAWINGS

An embodiment of the invention will be described in more detail below with reference to the drawings.

DETAILED DESCRIPTION OF THE INVENTION

The tangential thread-rolling head illustrated in the Figures, in its structure and way of action, largely corresponds to the tangential thread-rolling head of EP 0 811 443 B1. Reference is explicitly made to this disclosure in the aforementioned document.

The rolling head illustrated in the Figures has two fork-shaped rolling head arms (hereinafter also referred to as arms) 10, 12 which form part of a two-armed lever. The rolling head, in turn, is pivotally supported by a suitable holder (not shown) as will be briefly described farther below. The fork-shaped arms 10, 12 support thread-rolling dies (hereinafter also referred to as rolling dies) 14, 16 on an axle 18, 20 which transversely extends through the fork-shaped arms 10, 12. It is made of a suitable hard metal.

Figure 1:
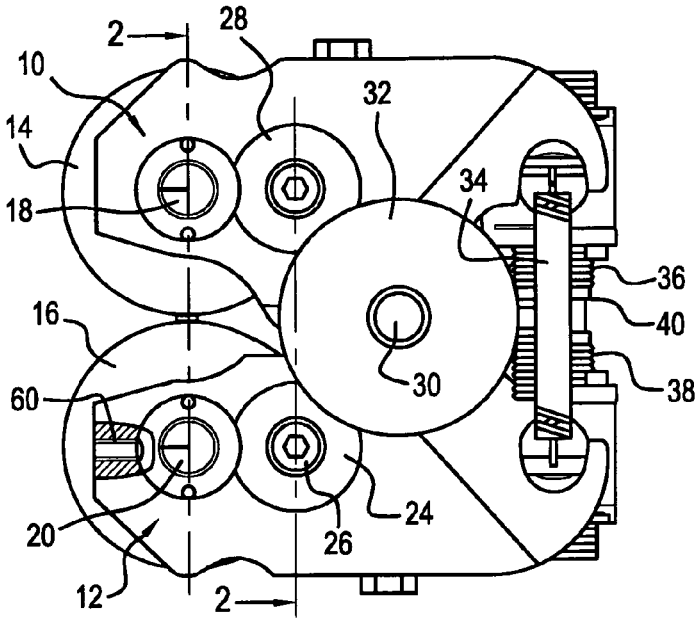
FIG. 1 shows a side view of a tangential thread-rolling head according to the invention.
Figure 2:
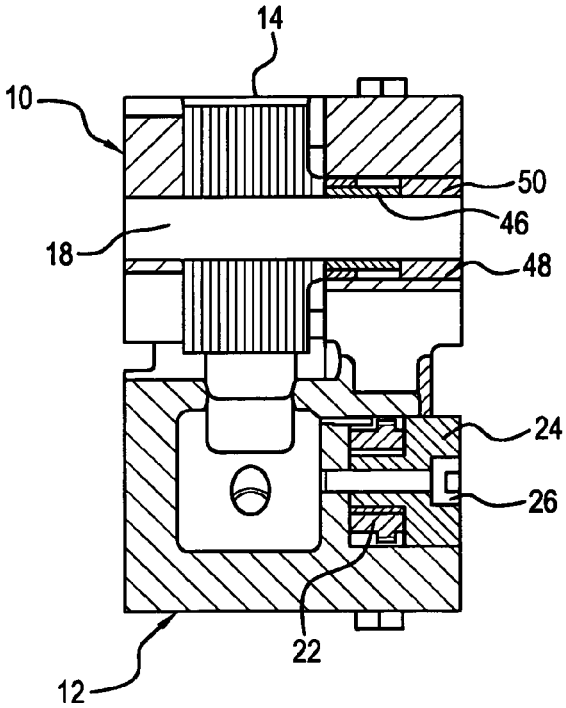
FIG. 2 shows a section through the representation of FIG. 1 along line 2—2.

As can be seen from FIG. 2 the right-hand fork portion is wider than the left-hand fork portion. The reason is that the wider fork portion has arranged therein a gear unit. The gear is designated 22 in FIG. 2. It is rotatably supported by a bushing 24 which is seated in part in a circular recess of the arm 10 or 12 and is firmly pressed against the bottom of the recess by means of a fillister head screw 26. The bushing in question is designated 28 in the upper part in FIG. 1.

An axle 30 extends through the central hole of a disk 32, through invisible portions of the arms 10, 12, and non-illustrated legs of the mounting body. The arms 10, 12 can be pivoted against each other about the axle 30 while being tensioned towards each other by means of a spring 34, which engages the other arms of the two-armed levers, in the area of the rolling dies 14, 16. Suitable stops, which are not shown or described in detail, help limit the lever pivoting motion such as would cause a motion of the rolling dies 14, 16 away from each other. Two spring assemblies 36, 38 on either side of a nose 40, which belong to the non-illustrated mounting body, allow to partially pivot the whole tangential thread-rolling head about the axle 30. With regard to this function, explicit reference is made to EP 0 811 443 B1 which was mentioned already.

It should also be mentioned that the axle 30 seats a gear (not shown) which is engaged by the gears 22 on the bushings 24, 28. Since the gears 22, in turn, are in engagement with the respective pinion which is in a fixed engagement for rotation with the thread-rolling dies 14, 16 the thread-rolling dies 14, 16 are in synchronism in their rotation.

Figure 3:
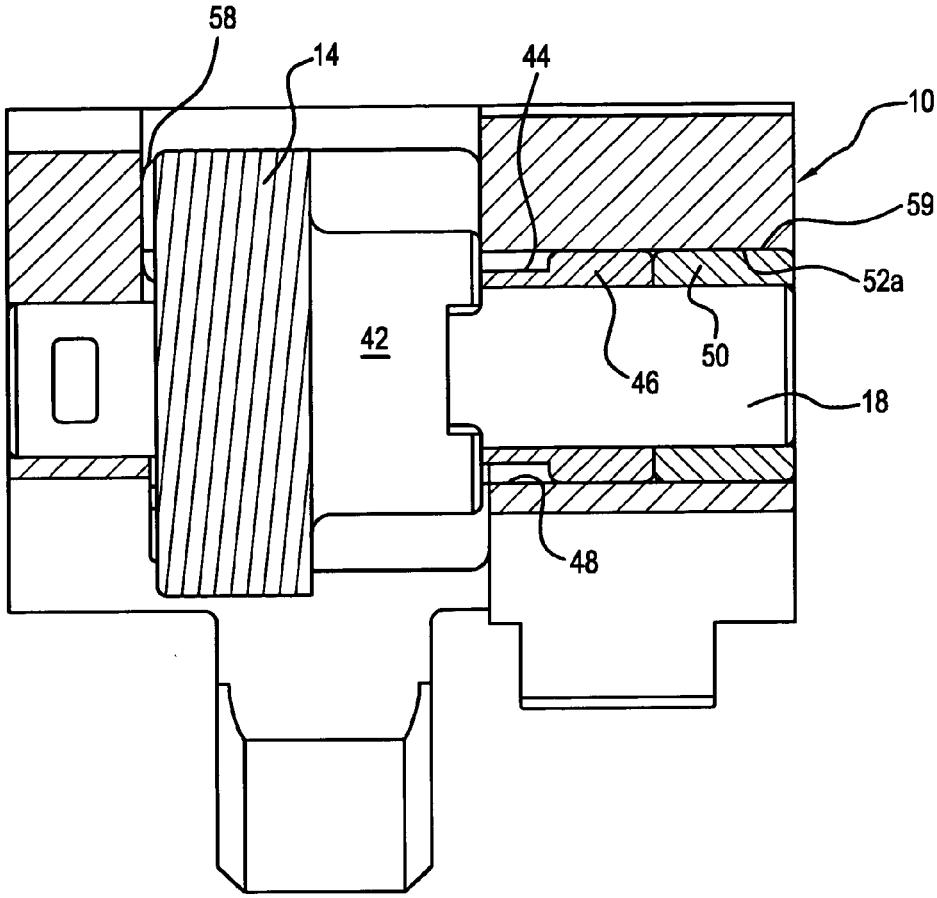
FIG. 3 shows some portion of the representation of FIG. 2 at a larger scale.

It is shown in FIGS. 2 and 3 that the thread-rolling die 14 has jaws 42 which are in engagement with jaws 44 on the pinion 46. The pinion is rotatably seated on the axle 18. It is understood that this equally applies to the thread-rolling die 18.

Figure 4:
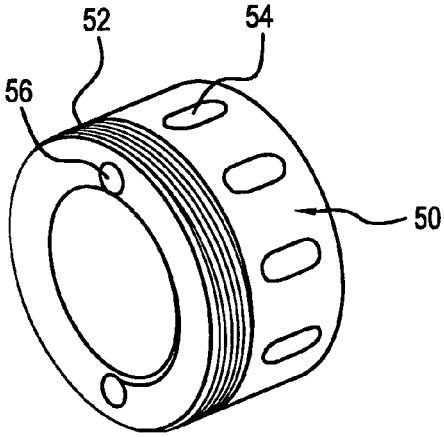
FIG. 4 shows a perspective view of a bushing from the representation of FIGS. 2 and 3.

The axle 18 extends through a cylindrical bore 48 in the wider fork portion of the arm 10. The bore receives the pinion 46 and a bushing 50. The bushing 50 is pointed out more clearly in FIG. 4. It can be recognized that a fine-pitch threaded portion 52 is circumferentially formed near its free front face. It interengages with an appropriately mating threaded portion 52*a* in the bore 48. Beside the fine-pitch threaded portion 52, the circumference of the bushing 50 has ten grooves (or indentations) 54 which are formed in at equal peripheral spacings in an axially parallel relationship. Two holes 56 are formed and are diametrically opposed on the free front face of the bushing 50. If the bushing 50 is rotated it will also move axially. This makes it possible to axially shift the pinion 46 and, hence, the thread-rolling die 14 which bears against the wall surface facing it of the narrower form portion on the opposite side, via a thin disk 58.

As can be appreciated from FIG. 1 a clamping screw 60 is screwed into an appropriate thread in the arm 12 from the front side. The clamping screw 60 interacts with one of the grooves 54, thereby locating the bushing 50 in the sense of rotation.

Figure 5:
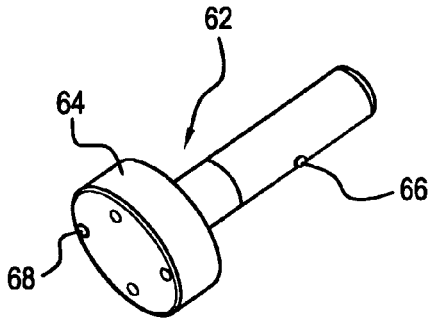
FIG. 5 shows a tool for the re-positioning of the bushing of FIG. 3.

In FIG. 5, a tool 62 is shown for the actuation of the bushing 50. It has a cylindrical head 64 and an elongate shank 66 which engages one side of the head 64. The free front face of the head 64 has two diametrically opposed pins 68 which are capable of interacting with the holes 56 of the bushing 50.

Before the bushing 50 can be re-positioned axially it is necessary to remove the respective clamping screws 60 for the two thread-rolling dies 14, 16. Subsequently, the tool 62 is used to press the bushing 50 against the respective pinion 46 until the thread-rolling die 14, 16 is fixedly seated. Afterwards, the bushing 50 is then rotated in an opposite sense until the clamping screw 60 can engage the succeeding groove 54. The clamping screw 60 is then tightened.

The invention claimed is:

1. A tangential thread-rolling head comprising two fork-shaped rolling head arms in which thread-rolling dies are rotatably supported by means of parallel axles wherein the thread-rolling dies are in a lateral engagement with a pinion seated on the axles of a gearing coupling both thread-rolling dies and the thread-rolling dies and pinions have lateral jaws such that the jaws of the thread-rolling dies can be pushed into the jaws of the pinions laterally before the axles are mounted wherein the axles have disposed thereon an axially slidable bushing which is adapted to firmly be positioned axially against the pinion with the aid of locating means, characterized in that each bushing (50) circumferentially has a fine pitch threaded portion (52) which interengages with a female-threaded portion (52*a*) in a seating bore (48) for the pinion (46) and bushing (50) and locking means are provided in the rolling head arms (10, 12) to lock the bushing (50) in an occupied rotational position.

2. The tangential thread-rolling head according to claim 1, characterized in that the bushing (50), axially beside the fine pitch threaded portion (52), has indentations (54) which are arranged at equal spacings at the circumference of the bushing (50), and a clamping screw (60) which interacts with an indentation (54) is inserted into a threaded hole of the rolling head arm.

3. The tangential thread-rolling head according to claim 2, characterized in that the clamping screw (60) is adapted to be screwed into the rolling head arm (10, 12) from the front end thereof.

4. The tangential thread-rolling head according to claim 1, characterized in that the bushing (50) has holes for an engagement by a rotating tool (62), at the outwardly facing front side.

5. The tangential thread-rolling head according to claim 2, characterized in that the bushing (50) has holes for an engagement by a rotating tool (62), at the outwardly facing front side.

6. The tangential thread-rolling head according to claim 3, characterized in that the bushing (50) has holes for an engagement by a rotating tool (62), at the outwardly facing front side.

* * * * *